US008413959B2

(12) United States Patent
Bloswick et al.

(10) Patent No.: US 8,413,959 B2
(45) Date of Patent: Apr. 9, 2013

(54) PROBE BAR REMOVER

(75) Inventors: Donald S. Bloswick, Salt Lake City, UT (US); Duane A. Ferkovich, Saratoga Springs, UT (US); Richard F. Sesek, Salt Lake City, UT (US); Bruce Campbell, Palatine, IL (US)

(73) Assignee: University of Utah Research Foundation, Salt Lake City, UT (US)

( * ) Notice: Subject to any disclaimer, the term of this patent is extended or adjusted under 35 U.S.C. 154(b) by 0 days.

(21) Appl. No.: 12/295,415

(22) PCT Filed: Mar. 29, 2007

(86) PCT No.: PCT/US2007/007969

§ 371 (c)(1),
(2), (4) Date: Apr. 22, 2009

(87) PCT Pub. No.: WO2007/123726

PCT Pub. Date: Nov. 1, 2007

(65) Prior Publication Data

US 2009/0242859 A1 Oct. 1, 2009

Related U.S. Application Data

(60) Provisional application No. 60/744,005, filed on Mar. 30, 2006.

(51) Int. Cl.

| | |
|---|---|
| ***E21B 19/00*** | (2006.01) |
| ***B66F 3/00*** | (2006.01) |
| ***H05K 7/20*** | (2006.01) |
| ***H05K 7/00*** | (2006.01) |
| ***H01K 1/14*** | (2006.01) |
| ***B23P 19/02*** | (2006.01) |

(52) U.S. Cl.
USPC ..... 254/30; 254/120; 254/131; 361/700; 361/705; 361/740; 29/251

(58) Field of Classification Search ..... 254/30, 254/131, 120, 133 R; 361/700, 705, 707, 361/709, 740; 29/251, 856
See application file for complete search history.

(56) References Cited

U.S. PATENT DOCUMENTS

| | | | | | |
|---|---|---|---|---|---|
| 539,851 | A | * | 5/1895 | Bedford | 280/47.24 |
| 1,426,068 | A | * | 8/1922 | Howe | 254/120 |
| 1,472,102 | A | * | 10/1923 | Uriga | 172/352 |
| 1,761,675 | A | * | 6/1930 | Mick | 254/132 |
| 1,911,287 | A | * | 5/1933 | Pladson | 254/130 |

(Continued)

*Primary Examiner* — Lee D Wilson
*Assistant Examiner* — Alvin Grant
(74) *Attorney, Agent, or Firm* — Thorpe North & Western LLP

(57) ABSTRACT

A probe bar remover (10) for loosening and removing probe bars from the ground includes an elongated member (12) with an engagement end and a handling end. The elongated member (12) also includes a foot plate (18) along the elongated member (12) oriented toward the handling end. A bar engagement member (20) is coupled to the elongated member (12) at the engagement end and can include an engagement gap (22) for engaging a probe bar (15). A fulcrum (24) can be oriented along the elongated member (12), which contacts a ground surface, and a handlebar (26) is removably coupled to the handling end of the elongated member. To remove probe bars from a ground surface, the probe bar remover (10) can be engaged with an exposed portion of a probe bar (15) and a downward force is exerted on the foot plate (18) so as to at least loosen the probe bar (15) from the ground.

22 Claims, 5 Drawing Sheets

U.S. PATENT DOCUMENTS

| | | | | | |
|---|---|---|---|---|---|
| 2,777,726 | A | | 1/1957 | Lundgren et al. | |
| 3,463,337 | A | * | 8/1969 | Reznicek | 414/428 |
| 3,736,665 | A | * | 6/1973 | La Moreux | 33/203 |
| 3,808,695 | A | * | 5/1974 | LaMoreux | 33/203 |
| 3,985,338 | A | * | 10/1976 | Herrmann | 254/131 |
| 4,161,310 | A | | 7/1979 | Parker | |
| 4,250,769 | A | * | 2/1981 | Herring | 74/525 |
| 4,338,691 | A | * | 7/1982 | Gaffney | 4/562.1 |
| 4,365,925 | A | * | 12/1982 | Girtz | 414/684.3 |
| 4,488,706 | A | * | 12/1984 | Kono | 254/131 |
| 4,662,607 | A | * | 5/1987 | Mochizuki et al. | 254/131 |
| 4,738,433 | A | * | 4/1988 | Hoff | 254/30 |
| 4,856,759 | A | * | 8/1989 | Ness | 254/132 |
| 4,872,694 | A | * | 10/1989 | Griesinger | 280/79.4 |
| 5,022,632 | A | | 6/1991 | Beidock | |
| 5,186,437 | A | * | 2/1993 | Scott | 254/30 |
| 5,257,892 | A | * | 11/1993 | Branch | 414/490 |
| 5,292,107 | A | * | 3/1994 | Chick | 254/131 |
| 5,464,192 | A | * | 11/1995 | Burnham | 254/30 |
| 5,499,795 | A | * | 3/1996 | Mathews | 254/30 |
| 5,597,151 | A | | 1/1997 | Duncan | |
| 5,713,559 | A | * | 2/1998 | McClarin et al. | 254/124 |
| 5,934,649 | A | * | 8/1999 | Drane | 254/30 |
| 6,015,256 | A | * | 1/2000 | Mesa et al. | 414/678 |
| 6,131,884 | A | * | 10/2000 | Broussard et al. | 254/30 |
| 6,202,985 | B1 | * | 3/2001 | Chong et al. | 254/131 |
| 6,302,376 | B1 | | 10/2001 | Williams | |
| 6,302,378 | B1 | * | 10/2001 | Koch et al. | 254/131 |
| 6,367,779 | B1 | | 4/2002 | Martin et al. | |
| 6,467,746 | B1 | * | 10/2002 | Paskiewicz | 248/349.1 |
| 6,520,482 | B1 | * | 2/2003 | Bigham | 254/131 |
| 6,527,250 | B1 | * | 3/2003 | Tyson | 254/30 |
| 6,682,049 | B2 | * | 1/2004 | Thompson | 254/8 R |
| 6,752,382 | B2 | * | 6/2004 | Barto | 254/131 |
| 7,036,832 | B2 | * | 5/2006 | Gargaro | 280/47.131 |
| 7,040,602 | B1 | * | 5/2006 | Williams | 254/30 |
| 7,111,418 | B2 | * | 9/2006 | Noonan | 37/265 |
| D609,540 | S | * | 2/2010 | Oberg | D8/51 |
| 7,798,384 | B2 | * | 9/2010 | Paske | 227/15 |
| D657,218 | S | * | 4/2012 | Wilder | D8/51 |
| 2010/0213425 | A1 | * | 8/2010 | Davis | 254/131 |

* cited by examiner

PROBE BAR REMOVER

RELATED APPLICATIONS

This application claims priority to U.S. Provisional Application No. 60/744,005, filed Mar. 30, 2006, which is incorporated herein by reference.

FIELD OF THE INVENTION

The present invention relates generally to methods for removing probe bars such as those used to search for underground gas leaks.

BACKGROUND OF THE INVENTION

Gas distribution is often done through underground pipes. Due to the severity of the possible effects of leaks and the generally inaccessible nature of the pipes, various methods have been devised for checking for such leaks. Currently, the most predominant method involves driving a long metal rod or probe (often ⅜" to ½" in diameter) into the ground.

Driving the rod into the ground can prove to be difficult. As such, driving the rod into the ground can be accomplished using a sliding weight that impacts a fixed collar on the rod. The user lifts the weight and slams it down onto the collar, creating the force necessary to drive the rod into the ground. This is repeated to achieve the desired depth. Other methods can also be employed which rely on creating a downward force on the rod sufficient to drive the rod into the ground. For example, a small (5 lb.) sledge hammer can be used to drive a hardened bar into the ground.

Depending on conditions, removing the rod can prove more difficult than initially driving the rod into the ground. This is particularly true where the rod is driven into asphalt or other dense materials. It is also sometimes made difficult when the ground is frozen as the bar tends to heat during insertion, thus melting water in the surrounding soil, which can subsequently freeze the bar into the ground. Bars that prove difficult to remove, or "stuck" bars are often removed through two methods. First, the weight used to pound the weight into the ground may be used in a reverse motion. The weight can be lifted and hit against the collars on the rod, thus using the weight in an upward motion. Secondly, a lever device can be used.

At present, the levers used generally have "teeth" that slide onto and grip the bar. A lever will also have a pivot point approximately 6-8 inches away from where the teeth grip the bar. Handles extend from the device for approximately 48 inches from the pivot point. To use the lever, a user would position the teeth so as to grip the bar appropriately, and then the user can grip the end of the handle with his or her hands and push down. This action creates an approximate 6-1 or 8-1 mechanical advantage, which in turn creates enough lifting force on the stuck bar to lift it at least partially from the ground.

Although this lever method generally works for most stuck bars, it can be hard on the user. In order to properly work a lever for this purpose, the user must flex his or her torso and bend down to create the necessary downward force. This bending motion is not good biomechanical loading on the body and may have negative immediate and/or long-term effects.

Additionally, current levers are often heavy and may further cause strain on a user for initially positioning the lever near the stuck rod, and returning the equipment. Further, some currently used levers prove awkward in handling in that they may require the user to exert time and effort in properly setting-up the apparatus and in maintaining balance of the tool.

SUMMARY OF THE INVENTION

Accordingly, there exists a need to create a tool and method whereby probe bars can be ergonomically and efficiently removed from the ground. Preferably, this tool and method would be relatively easy in handling and using, and would improve the biomechanical loading required for use over that of currently used tools.

As such, the present invention presents a probe bar remover that has an elongated member with an engagement end and an opposite handling end and a foot plate near the handling end. The bar remover has a bar engagement member attached to the elongated member at the engagement end. An engagement gap can be included in the engagement member and can be used to engage a probe bar. The bar remover also has a fulcrum at a point along the elongated member which can contact a ground surface and can further provide a fulcrum point for the apparatus. Additionally, the probe bar remover has a handlebar extending away from and attached at the handling end of the elongated member.

For ease of transport and/or orientation, the fulcrum can further comprise two wheels that can contact the ground. Optionally, the wheels can be designed so as to have a locking mechanism whereby the wheels can be locked to prevent rotation and stabilize the unit during operation.

In one embodiment, the foot plate can be a plate affixed to a top surface of the elongated member. In some designs, the elongated member can be cylindrical in shape and the foot plate can be a flat plate attached to the elongated member so as to provide a flat surface whereby force can be exerted. Alternately, the elongated member can be of a shape resembling a flattened cylinder. In yet another embodiment, the foot plate is an integrated plate along a section of the elongated member.

In one embodiment the engagement gap is an open gap configured to engage a probe bar wherein one section of the gap is open when engaged with the probe bar. Another embodiment has the bar engagement member configured to resemble a fork with prongs oriented substantially perpendicular to the elongated member, and preferably at a direction substantially parallel to the ground. As a further modification of this embodiment, the bar engagement member can be an elongated member having a fork-shaped portion wherein the prongs of the fork are oriented substantially perpendicular to the elongated engagement member. In other embodiments, the bar engagement member can be in the shape of an adjustable wrench head. An adjustable engagement member can allow for easy adjustment to engage a wide variety of bar diameters. As with the fork design, a wrench head portion can be only a portion of the bar engagement member. To aid in engaging the probe bar, the engagement member can have teeth that extend primarily inward, towards the open gap or area wherein the engagement member is to contact the probe bar. These teeth or corrugated features allow for an increased grip of surfaces of the probe bar.

In one embodiment, the bar engagement member can be pivotally attached to the elongated member. The attachment can further restrict the range of motion so as to limit the engagement member to a planar range in line with the elongated member which allows a folding and unfolding action for compact storage and improved manipulation during use.

To further improve the distance the lever can be moved downward, the probe bar remover can be modified so that the elongated member is bent upwardly at an angle towards the engagement end. An upward bend in the elongated member can provide improved strength to the elongated member and also elevates the member, e.g. the foot plate, to increase the distance that the lever can be pushed downward.

The handlebar of the probe bar remover can also include a variety of optional modifications. In one embodiment, the handlebar can include a mechanism to allow adjustment of the handle length so as to better meet the ergonomic needs of a particular user 4- or users or to aid in transportation or storage. This modification can be accomplished by any suitable mechanism such as, but not limited to, one or more friction-fitting joints, screw-fitting joints, and slot-and-pin joints that can have multiple slot positions. In one embodiment, the handle can be collapsible such that the handle can be oriented substantially parallel to the elongated member to facilitate storage or transport. As a further modification, the handle can be detachable from the elongated member, e.g. using a quick-release, slot-pin, levered cam, or other similar mechanism.

The probe bar remover of the present invention can further comprise a bar driver slidably coupled to the probe bar. The probe bar can be pivotally engaged by the elongated member so that the elongated member can be positioned either substantially parallel to the bar driver when the bar is being driven into the ground, or substantially perpendicular to the bar when the bar is being loosened removed from the ground.

The overall design of the probe bar remover can be modified to facilitate transportation by using light-weight materials in the design of all or any of the components of the probe bar remover, particularly the elongated member. By doing so, the probe bar remover can be considered light-weight, and thus more user-friendly. In particular, the overall design can weigh less than about 20 pounds, and preferably less than about 11 pounds.

As a further aspect of this invention, a method for removing probe bars is presented. To remove probe bars from a ground surface, a probe bar remover of the sort described previously can be used having an elongated member having an engagement end opposite a handling end and a foot plate oriented at the handling end. A bar engagement member can be attached to the elongated member at the engagement end and can include an engagement gap configured to engage a probe bar. A fulcrum can also be disposed intermediate the elongated member and can be configured to contact a ground surface to provide a fulcrum point. Further, an elongated handlebar can be pivotally coupled at the handling end which extends upward from the elongated member. The probe bar remover of the present invention can be engaged with an exposed portion of a probe bar. A downward force can then be exerted on the foot plate of the probe bar remover such that an upward force is exerted on the probe bar via lever action sufficient to at least partially loosen the probe bar from the ground.

Additionally, releasing the bar engagement member can be performed by moving the foot plate upward, and repeating the step of exerting a downward force until the probe bar is loosened from the ground. The movement of the foot plate in an upward direction can be aided through exerting an upward force such as by pulling upward on the handlebar. Optionally, a foot clip or stirrup can be attached near the foot plate in an operative position so that the foot can slide into the foot clip. This can further aid in lifting the foot and the footplate. This lifting process can be optionally repeated until the bar is loosened from the ground to an extent that the user can pull the probe bar free from the ground without the aid of tools.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
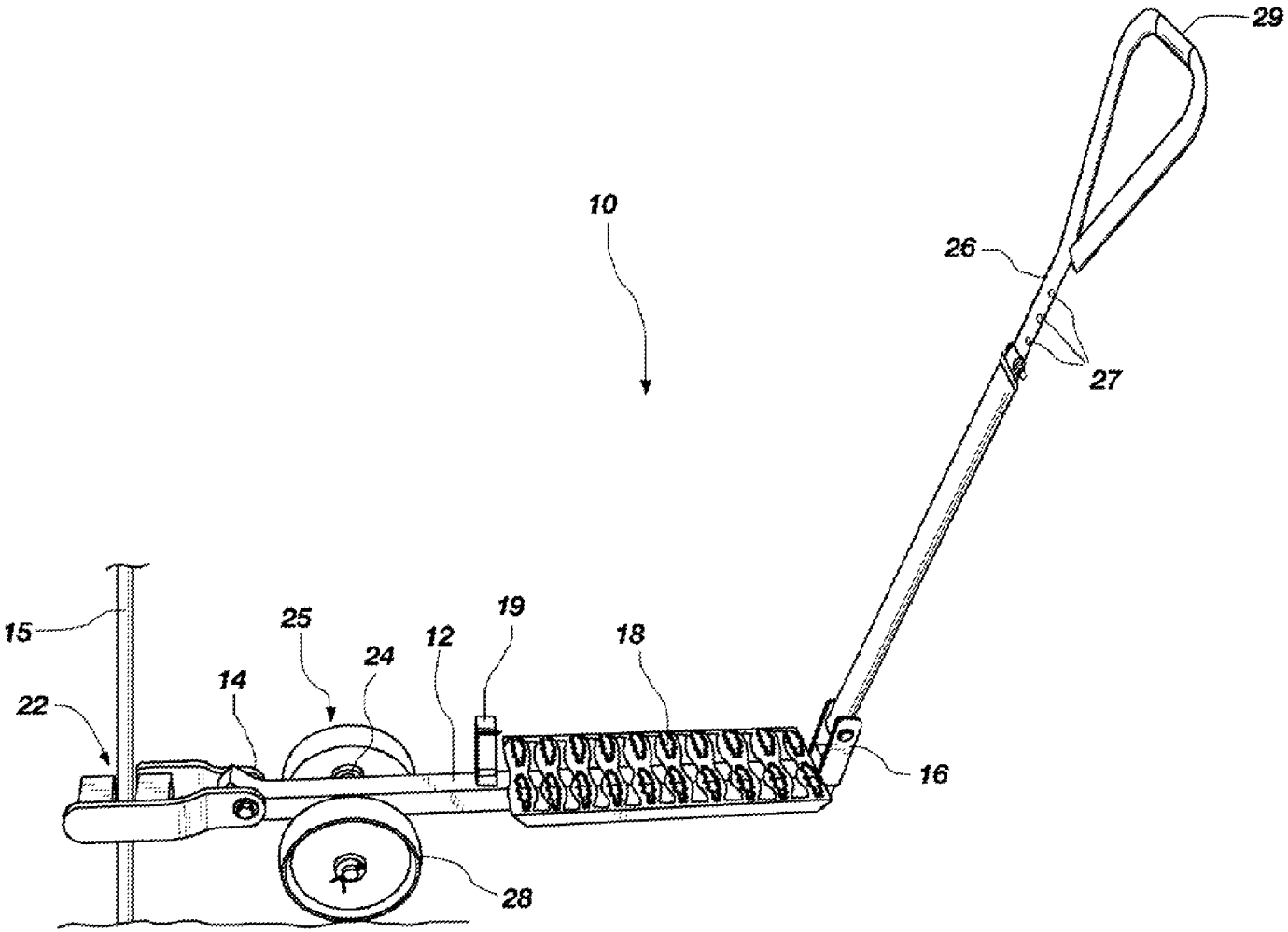
FIG. 1 is a perspective view of a probe bar remover in accordance with one embodiment of the present invention. The embodiment shown is in a ready-to-use position wherein the handlebar is attached and extended upward and away from the elongated member.

The drawings will be described further in connection with the following detailed description. Further, these drawings are not necessarily to scale and are by way of illustration only such that dimensions and geometries can vary from those illustrated.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a friction-fitting joint" is not to be taken as quantitatively or source limiting and can refer to one or more of such joints, and reference to "a releasing step" can include multiple such steps.

Definitions

In describing and claiming the present invention, the following terminology will be used in accordance with the definitions set forth below.

As used herein, "ground" and "ground surface" refer to any surface into which a probe bar can be inserted. Ground, therefore, includes earthen materials such as sand, gravel, clay, compacted soil and rock; as well as man-made materials such as cement and asphalt. In the present usage, "surface" includes and extends to the depths that probe bars can be inserted into the ground.

As used herein, "foot plate" refers to any member oriented as to accommodate a downward force. Typically, a foot plate will include a geometry and features which increase friction with an applied foot sufficient to reduce risks of slipping during use.

As used herein, "light-weight materials" refers to any material of sufficient strength to carry-out the desired operation of the component which is constructed of a material which is lighter than iron or carbon steel. This term is to be taken with what is consistent with generally known usage in the art of material fabrication, specifically structural metals and composites.

As used herein, a plurality of items, structural elements, compositional elements, and/or materials can be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Dimensions, amounts, and other numerical data may be presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "less than about 20 pounds" should be interpreted to include not only the explicitly recited values of about 20 pounds and less, but also include individual values and sub-ranges within the indicated range. Thus, included in this numerical range are individual values such as 17.5, 5.25 and 10 and sub-ranges such as from 10-15, from 10-11, and less than 10, etc. Furthermore, such an interpretation should apply regardless of the breadth of the range or the characteristics being described.

The Invention

The present invention relates to an apparatus and associated methods wherein probe bars, having been inserted into the ground, can be loosened and removed from the ground in a manner that is ergonomic, energy efficient, less physically demanding and less harmful to a user than conventional probe bar removers.

As shown in FIG. 1, the probe bar remover 10 of the present invention can comprise an elongated member 12, which serves as a lever and has an engagement end 14 opposite a handling end 16. In a preferred embodiment, a foot plate 18 can be oriented at the handling end of the elongated member. The probe bar remover can further include a bar engagement member 20 attached to the elongated member at the engagement end configured to engage a probe bar. A fulcrum 24 can be disposed intermediate the elongated member and configured to contact a ground surface to provide a fulcrum point 25 for the elongated member. In one embodiment an elongated handlebar is removably coupled at the handling end and extends away from the elongated member.

In a related method for loosening and removing probe bars from the ground, an exposed portion of a probe bar can be engaged with a probe bar remover of the present invention. A downward force can be exerted on the foot plate of the probe bar remover such that the bar engagement member is forced upward sufficient to loosen the probe bar from the ground. In one aspect of the method of the present invention, the bar engagement member can be released by moving the foot plate upward and repeating the step of exerting a downward force until the probe bar is loosened from the ground.

In accordance with these embodiments, various details are provided herein which are applicable to both the probe bar remover and the associated method for loosening and removing probe bars from the ground.

FIG. 1 shows an example of one embodiment of a probe bar remover 10 in accordance with one embodiment of the present invention. According to this embodiment, a bar engagement member 20 is extended in a forward position with respect to the elongated member 12. The bar engagement member is in the shape of a fork having prongs oriented substantially perpendicular to the elongated member to which it is attached. The elongated member in this embodiment is a long metallic body having a rectangular cross-section with four substantially flat edges on the length of the body. Attached near the engagement member and along the elongated member are two wheels 28 acting as a fulcrum point 25 for the probe bar remover 10 and aiding in transportation of the apparatus and maneuvering the same around a probe bar.

Also attached to the elongated member 12 is a foot plate 18. The foot plate can be attached to the top surface of the elongated member and oriented towards the portion of the elongated member that is opposite the engagement member 20. According to one embodiment of the present invention, the elongated member adopts a singular construction whereby the foot plate is an integral portion of the elongated member. Preferably, the foot plate is configured to reduce slippage when a person places his or her foot upon the foot plate and exerts a force thereon. In one embodiment, the foot plate can be of a size sufficient to accommodate a human foot. Specifically, the foot plate can be about the width of an average human foot and at least two inches in length. The foot plate can also include a surface having traction-increasing tread variations, a non-slip coating, or a combination of such features for purposes of promoting slip resistance. Additionally, the foot plate 18 can be positioned for ease of use and so that a user of the probe bar remover 10 is not required to lift his or her leg to a height beyond that which is comfortable for the average person. In one embodiment, the foot plate is no more than 3 feet from the surface of the ground. In another embodiment, the foot plate is less than 1½ foot from the surface of the ground during use.

In practice, a user of the device can step onto the foot plate 18, exerting a downward force on the foot plate and thus impacting the handling end 16 of the elongated member 12.

Since the elongated member operates in a lever-like fashion, the force on the engagement end 14 of the elongated member will be upward and sufficient to loosen a probe bar 15 from the ground. Once the probe bar is loosened from the ground, a user can simply pull the probe bar from the ground using his or her hands. Generally, the force created by the bodyweight of the user alone is sufficient to loosen a probe bar from the ground, regardless of the user's bodyweight or size. However, in some cases a user can increase the amount of force applied by also exerting a downward force on the handlebar 26 using his or her upper body strength. A user can also loosen the probe bar from the ground by repeating the step of exerting a downward force until the probe bar breaks loose.

Other features of the present invention can also result in an increase of force applied when removing a probe bar 15. For example, in one embodiment, the elongated member 12 can bend at an upward angle beginning just past the fulcrum 24 from the foot plate 18. This design can increase the length of the probe bar that can be lifted in one iteration as the probe bar remover 10 can be pulled up to a higher angle prior to exerting a downward force on the foot plate. Further, the bend can also provide increased structural strength against downward forces of resistance from the probe bar. As shown in FIG. 1, a handlebar 26 can be attached to the handling end 16 of the elongated member 12 and can extend away from the elongated member. The handlebar is especially useful for providing stability to the user of the device, and can aid a user in maintaining his or her balance. The handlebar can also further enable a user to exert a downward force on the device using upper body strength for purposes of loosening or removing a probe bar 15 from the ground. In accordance with one embodiment, the handlebar can extend upward and away from the elongated member and has a distal portion whereby a user can grasp the apparatus via a hand grip 29. The handlebar can include a length adjustment mechanism 27 for variable adjustment of length. In one embodiment, the length adjustment mechanism can be a friction fitting joint. In another embodiment, the length adjustment mechanism can be a screw fitting joint. As shown in FIG. 1, the length adjustment mechanism can be a slot-and-pin joint having multiple slot positions. In practice, the handlebar of these embodiments can include at least two sections which are coupled to each other via any number of known joints. For example, in an embodiment having two sections, the upper section with the hand grip can be partially inserted into the lower portion and secured. Thus, the handle can be adjusted in length and oriented to accommodate differing hand positions, and to further accommodate users of varying heights and sizes.

Furthermore, according to one embodiment, the handlebar 26 can be collapsible. Specifically, in one aspect, the handlebar can comprise at least two sections. An upper section can be partially or fully inserted into lower sections in a telescoping fashion such that the length of the handlebar can be substantially reduced. In one embodiment, the length of the handlebar can be reduced to that of the length of a single section. In still yet a further embodiment, the handlebar can be hingedly attached to the elongated member 12 and can be removed and attached as the user desires. Another benefit of a hinged or pivot-type coupling is that the handle can pivot about the elongated member and be oriented substantially parallel to the elongated member for storage or transport, as shown in FIG. 2.

Figure 2:
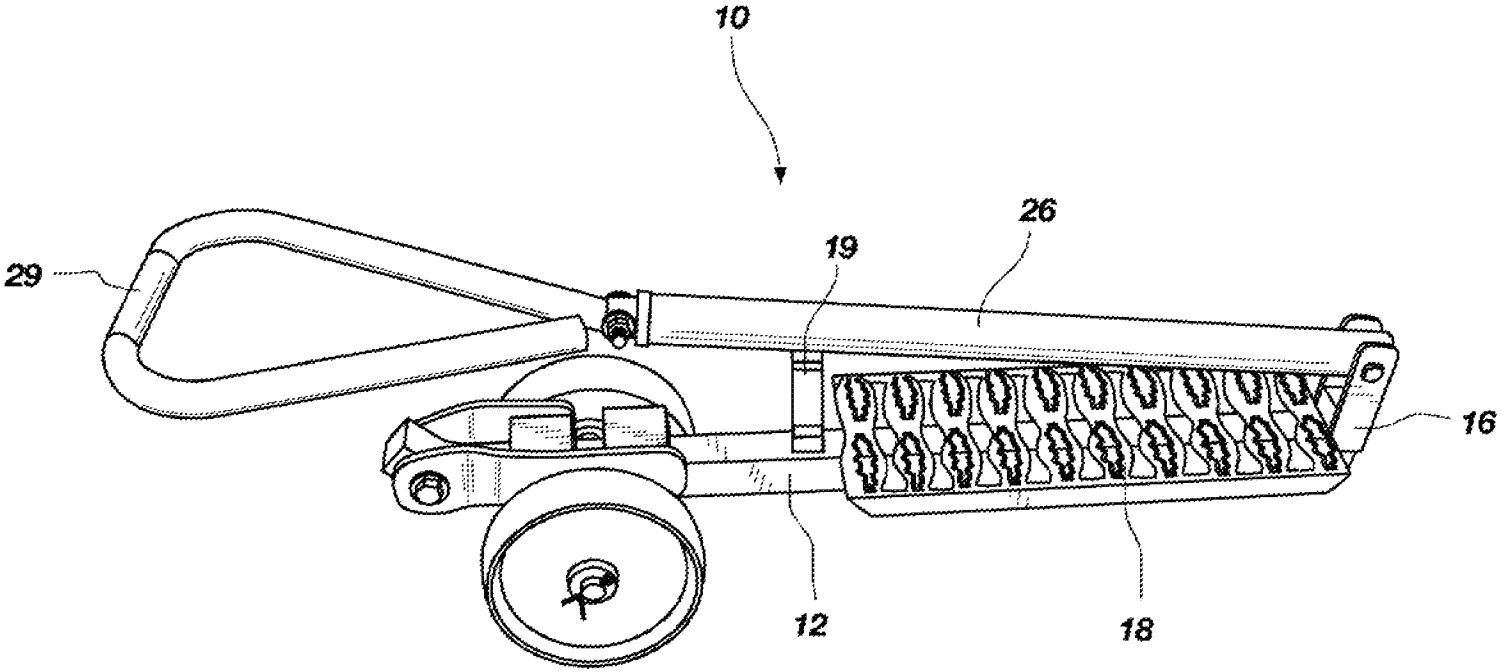
FIG. 2 is a perspective view of a probe bar remover in accordance with one embodiment of the present invention, wherein the probe bar remover includes wheels as the fulcrum, and wherein the probe bar remover is in a folded or collapsed state so as to facilitate transportation and/or storage.

According to this embodiment as illustrated in FIG. 2, the handlebar 26 can be folded over and rest substantially parallel to the elongated member 12. In a further embodiment, the bar engagement member 20 can also be folded under towards the ground and rest substantially parallel to the elongated member. In accordance with one embodiment, the engagement member can be swung up between the elongated member and handlebar for convenience in transport and storage. The devices of the present invention can further include a securing mechanism to retain the handlebar and/or bar engagement member in a storage position. For example, a clip, latch, detent, or other suitable mechanism can be operatively connected to the device to prevent movement of the handlebar and/or engagement member during transport. In another aspect, the handlebar and bar engagement members can be detachable and thus removed for storage, transportation and certain applications where a handle may not be necessary for use in removing a probe bar 15 from the ground.

Figure 3:
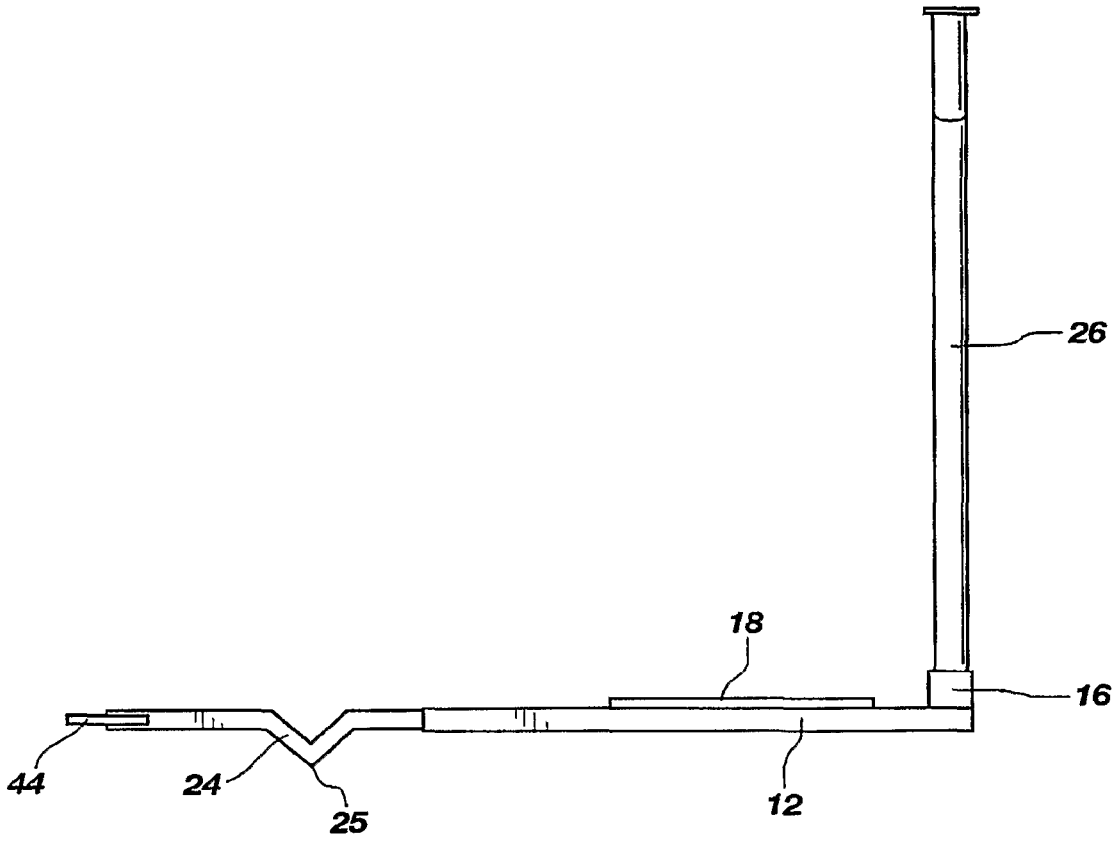
FIG. 3 is a side view of a probe bar remover, wherein the fulcrum is integral with the elongated member.

The fulcrum of the present invention serves to provide support or a fulcrum point about which a lever-like elongated member can pivot. In accordance with one embodiment, as shown in FIG. 3, the fulcrum 24 can be integral with the elongated member 12, and can provide a fulcrum point 25 about which the elongated member can pivot. In another embodiment, wheels 28 can serve as the fulcrum as shown in FIGS. 1 and 2. The wheels can also be useful for repositioning the probe bar remover 10 into a position that makes it easier to engage the probe bar 15. In one embodiment, the wheels can be utilized for transporting the device. In a further embodiment, a lock mechanism can be operatively associated with the wheels to prevent rotation of the wheels when being used as a fulcrum. In a preferred embodiment, the locking mechanism can be activated and deactivated by a user's foot.

Turning now to the bar engagement member, the bar engagement member is attached to the engagement end of the elongated member. The engagement member of the present invention can take on any variety of configurations suitable for engaging a probe bar. In one embodiment, the engagement member can include an engagement gap for engaging the probe bar. As shown in FIGS. 1, 4*b* and 4*c*, the engagement gap 22 can be an open gap configured to engage a probe bar 15 wherein one section of the gap is open when engaged with a probe bar. In another embodiment, a modified engagement member can include two plates welded to a bar extending from an elongated member of the apparatus. The two plates can be oriented to produce two engagement gaps whereby a probe bar can be engaged or contacted. This particular design allows for probe bar engagement from either side of the apparatus.

In yet another variation of a bar engagement member 20 as in FIG. 4*c*, a connecting piece 38 can extend substantially linearly away from the elongated member 12. Two flat, rectangular plates (not shown) can extend outward and perpendicular to the connecting piece to form at least one engagement gap 22. The rectangular plates can extend in either one or both directions away from the connecting piece. The engagement member can be hingedly attached to the elongated member 12 through the connecting piece. In an alternative embodiment, the engagement member can be fixedly attached to the elongated member so that it cannot pivot. According to one embodiment, the bar engagement member can be detachable from the elongated member. The detachable nature of the bar engagement member can be useful in situations where detaching may aid in transportation and storage and where the user may desire use of a different bar engagement member. Thus, a user can have a variety of bar engagement members that can be interchangeably used.

Figure 4A:
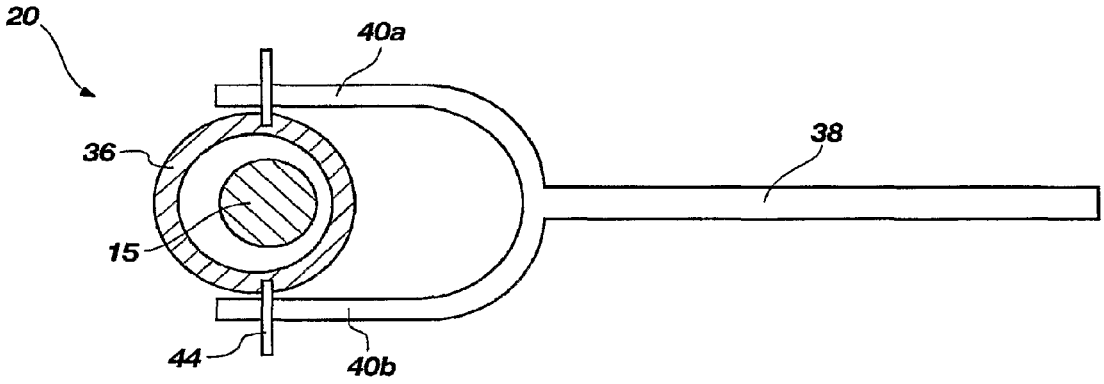
FIG. 4*a* is a top view of a bar engagement member in accordance with one embodiment of the present invention, wherein the bar engagement member is annular or washer shaped so that it completely encompasses the full diameter of the probe bar.
Figure 4B:
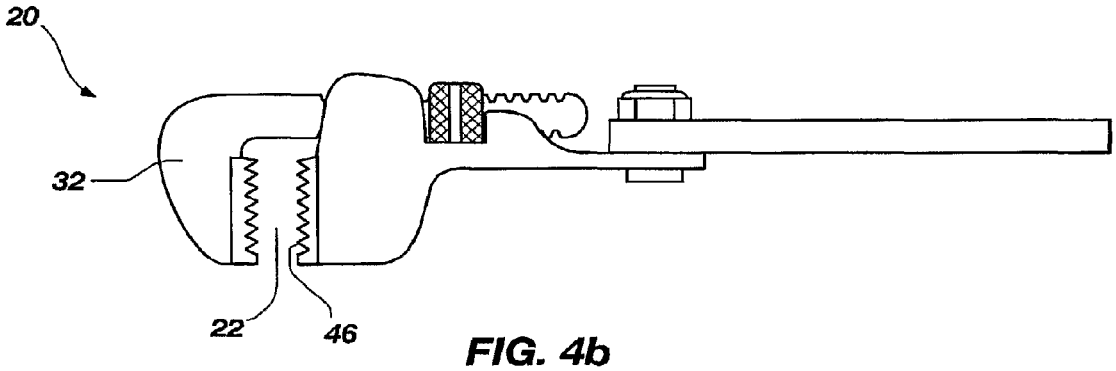
FIG. 4*b* is a top view of a bar engagement member in accordance with one embodiment of the present invention, wherein the bar engagement member is an adjustable wrench head.
Figure 4C:
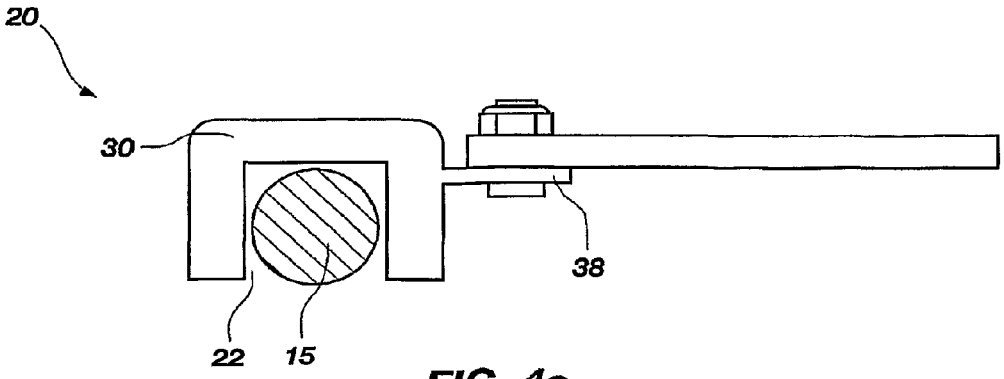
FIG. 4*c* is a top view of a bar engagement member in accordance with one embodiment of the present invention, wherein the bar engagement member is a fork having prongs oriented substantially perpendicular to the elongated member.

FIGS. 4*a*-4*c* illustrate a variety of embodiments of the engagement member 20 of the present invention. FIG. 4*a* shows one embodiment of an engagement member wherein the engagement member comprises a forked end, wherein fork prongs 40*a*, 40*b* can be oriented substantially parallel to the elongated member 12. An open ring or washer 36 can be rotatably coupled to and within the prongs and engage a probe bar 15. In one embodiment, the washer or open ring is coupled to the prongs with pins 44 on each side of the ring. In another embodiment, the bar engagement member can be a fork having prongs oriented substantially perpendicular to the elongated member. In a similar embodiment, the bar engagement member can be an adjustable wrench head as shown in FIG. 4*b*. Consistent with the design of wrenches, one or both sides of the engagement gap 22 can have teeth 46, ridges or corrugated features, which can aid in the engagement of the probe bar 15. The teeth can reduce inadvertent slippage or sideways movement of the engagement member during use. In one embodiment, the teeth can be parallel to the ground and perpendicular to the probe bar so as to increase gripping force while reducing slippage during application of force.

Figure 5A:
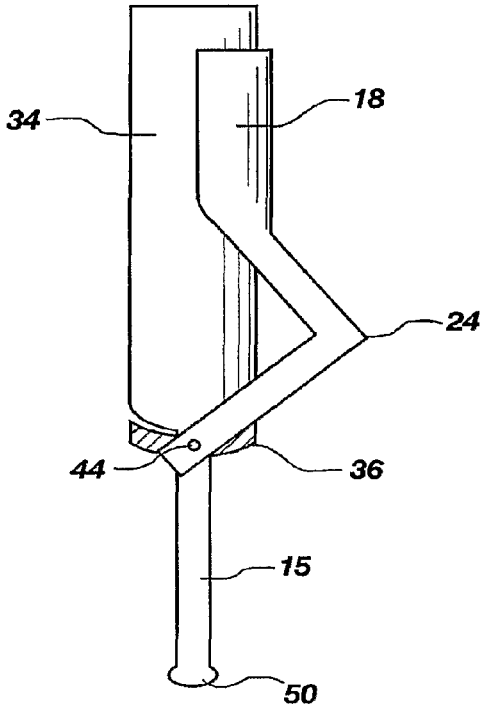
FIG. 5*a* is a perspective view of a probe bar remover in accordance with an alternative embodiment of the present invention, wherein the probe bar remover includes a bar driver slidably coupled to the probe bar, and wherein the elongated member is positioned substantially parallel to the bar driver.
Figure 5C:
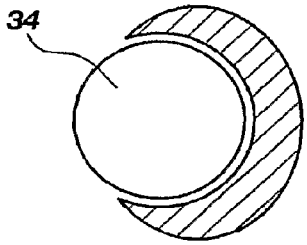
FIG. 5*c* is a top view of a probe bar remover in accordance with one embodiment of the present invention, wherein the probe bar remover includes a bar driver, and wherein the elongated member is positioned substantially parallel to the bar driver.
Figure 5D:
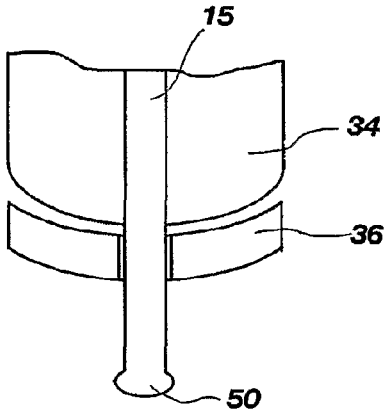
FIG. 5*d* is a sectional view of a probe bar remover in accordance with one embodiment of the present invention, wherein the probe bar is slidably coupled to a bar driver.
Figure 5B:
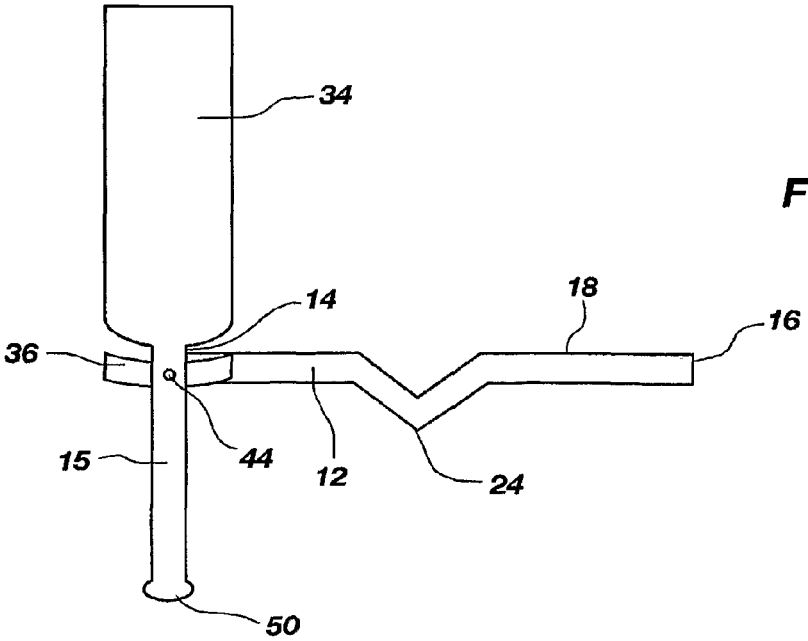
FIG. 5*b* is a perspective view of a probe bar remover in accordance with one embodiment of the present invention, wherein the probe bar remover includes a bar driver slidably coupled to the probe bar, and wherein the elongated member is positioned substantially perpendicular to the probe bar.

In some embodiments of the probe bar remover 10, the bar engagement member can be a combination of pins 44 and a washer 36 as shown in FIGS. 3, 4*a*, 5*a* and 5*b*. With respect specifically to these embodiments, pins can extend through prongs 40*a*, 40*b* oriented on an engagement end 14 of the elongated member 12 and into a washer 36 or open ring positioned between the prongs. The pins enable the elongated member to pivotally engage the probe bar 15 so that the elongated member can be positioned substantially parallel to the probe bar, as shown in FIG. 5*a*, and can also be positioned substantially perpendicular to the probe bar, as shown in FIG. 5*b*. In one embodiment, the probe bar remover 10 can further include a bar driver 34 slidably coupled to the probe bar. In embodiments comprising a bar driver, the foot plate 18 of the elongated member 12 be concave in shape so that it can conform to a cylindrical shape of the bar driver when the elongated member is in a folded in a position substantially parallel to the probe bar and bar driver. The probe bar 15 can be optionally slid through the washer 36 prior to inserting the bar into the ground.

In a similar aspect of the present invention, the probe bar remover 10 can be designed to allow integration directly with the bar driver. FIGS. 5*a*-5*d* illustrate a ladle-type probe bar remover in accordance with an alternative aspect of the present invention. Consistent with this embodiment, the bar engagement member 20 can be a loose washer 36 or open ring which will catch or engage a bar 15 inserted through the open center. The bar engagement member can be rotatably attached to a connecting piece 38 having prongs 40*a*, 40*b* via pins 44 or other suitable mechanisms. The pins that allow the washer to rotate can be slightly off-set to ensure engagement with the bar 15. The ladle itself can be a retrofit onto a standard bar driver 34. The inner diameter of the washer can fit over the ball end 50 on the bottom of the bar. The washer can be slid over the ball end on the bar and pulled up to the bottom of the bar driver. The washer 36 can be shaped like a cup to have a concave upper profile to fit over the bottom of the driver tube and keep out of the way of the bar driver. The "Y" handle of the device can also be shaped to fit over the half circumference of the bar driver. The foot plate 18 can be cupped or profiled to fit in a low profile snugly against the bar driver as shown in FIGS. 5*a* and 5*c*. To use the device the foot plate portion can be swung away from the bar driver and allowed to drop on the ground. The ground contact is the fulcrum 24. The washer slides down the rod, catches, and then pulls the rod up as downward force is placed on the foot plate. A latch (not shown) or other mechanism can be included to secure the probe bar remover 10 in place during use of the bar driver 34 to insert the bar into the ground. Further, the foot plate can be shaped to blend the profile of the foot plate into the bar driver when in the stored position as shown in FIG. 5*c*. Alternatively, the handle bar can be included in a foldable configuration so as to allow folding back over the foot plate 18. Specifically, a handle bar can be hingedly attached to a distal end or foot plate end of the elongated member. Another optional embodiment further includes a fabric stirrup, foot strap or other foot engagement member 19 attached to the footplate that allows lifting of the plate by engagement with the foot during lifting (see FIGS. 1-2).

In accordance with yet another aspect of the invention, a further design consideration can be the materials used to manufacture the probe bar remover 10. Ideally light-weight materials can be used to facilitate manipulation and transportation by a user. By way of example, materials that can be employed in the design of the probe bar remover can include, but are not limited to, aluminum, chrom-moly 4130, and the like. Various components can be made from carbon fiber or other composite materials so as to reduce the weight of the device. The weight can also be reduced by removing material from various members such as by molding or drilling holes where mechanical strength is not affected.

In a preferred embodiment, the probe bar remover 10 of the present invention can be used to remove probe bars 15 from a ground surface. The probe bar remover can be carried or transported to the location of the probe bar in an open or closed, i.e. transport position. The handlebar 26 can be rotated upward so as to be in a nearly perpendicular position relative to the elongated member 12. The bar engagement member 20 can be extended such that the engagement gap 22 can be engaged with the probe bar 15. Typically, the bar engagement member 20 can extend from the elongated member or can be oriented towards the ground, as shown in FIG. 1. The apparatus can also be oriented near the probe bar. The handlebar can be extended to a desired length using a length adjustment mechanism 27. The bar engagement gap can be pushed towards and around the probe bar. At this point, the probe bar 15 can be partially surrounded by the bar engagement member, e.g. three sides. The handlebar can be pulled upward to move the elongated member, thus raising the foot plate 18 upwardly, e.g. generally higher than the bar engagement member. In this position, the bar engagement member can be relatively low. As force is applied on the foot plate, e.g. by stepping on the foot plate, and an upward force is exerted on the bar engagement member sufficient to grasp the probe bar and loosen it from the ground and possibly also raise the probe bar upward. Most often, the handlebar and foot plate can be again raised and additional downward motions on the foot plate can be repeated until the probe bar is either completely removed from the ground or until the probe bar is sufficiently loosened to allow pulling the bar from the ground by hand. These steps can be done in rapid succession, thereby allowing quick removal of the bar while the user maintains a generally upright position. The present invention generally allows for one hand to be left on the to handlebar at the hand grip 29 and a second hand can be free to grip the probe bar. Of course, dimensions can be varied to provide minimal obstruction to use, improve strength, and/or aesthetics.

When the use of the probe bar remover 10 is no longer needed, the user can ideally move the bar engagement member 20 from the probe bar 15 with his or her foot. Wheels 28 can simplify repositioning the probe bar remover away from the probe bar once the probe bar has been loosened or removed. From there, the probe bar remover can be used to remove another probe bar or can be restored to the transportation/storage position through reversing the steps used to prepare the apparatus for use.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A probe bar remover comprising:

a) an elongated member having an engagement end opposite a handling end and a foot plate oriented at the handling end, wherein the foot plate is a plate positioned above a top surface of the elongated member or is an integrated plate along a section of the elongated member;

b) a bar engagement member attached to the elongated member at the engagement end configured to rotationally bind and releaseably engage a probe bar;

c) a fulcrum disposed intermediate the elongated member having a fulcrum point that can contact a ground surface; and d) an elongated handlebar removably coupled at the handling end and extending away from the elongated member.

2. A probe bar remover according to claim 1, wherein the fulcrum is a set of wheels.

3. A probe bar remover according to claim 2, further comprising a lock mechanism operatively associated with the wheels to prevent rotation.

4. A probe bar remover according to claim 1, wherein the foot plate is a plate affixed to the top surface of the elongated member.

5. A probe bar remover according to claim 1, wherein the bar engagement member includes an engagement gap for engaging the probe bar.

6. A probe bar remover according to claim 5, wherein the engagement gap is an open gap configured to engage a probe bar wherein one section of the gap is open when engaged with the probe bar.

7. A probe bar remover according to claim 6, wherein the bar engagement member is a fork having prongs oriented substantially perpendicular to the elongated member.

8. A probe bar remover according to claim 6, wherein the bar engagement member is an adjustable wrench head.

9. A probe bar remover according to claim 6, wherein the engagement member has teeth extending inwardly towards the open gap.

10. A probe bar remover according to claim 1, wherein the bar engagement member is pivotally attached to the elongated member.

11. A probe bar remover according to claim 1, wherein the elongated member is bent upwardly at an angle toward engagement end.

12. A probe bar remover according to claim 1, wherein the handlebar includes a length adjustment mechanism for variable adjustment of length.

13. A probe bar remover according to claim 12, wherein the length adjustment mechanism is a friction-fitting joint, a screw-fitting joint, or a slot-and-pin joint having multiple slot positions.

14. A probe bar remover according to claim 1, wherein the handlebar is collapsible such that the handlebar can be oriented substantially parallel to the elongated member for storage or transport.

15. A probe bar remover according to claim 1, wherein the handlebar pivots about the elongated member.

16. A probe bar remover according to claim 1, wherein the elongated member comprises light-weight materials.

17. A probe bar remover according to claim 1, wherein the probe bar remover weighs less than about 20 pounds.

18. A probe bar remover according to claim 1, wherein the probe bar remover weighs less than about 11 pounds.

19. A probe bar remover according to claim 1, further comprising a bar driver slidably coupled to the probe bar, and wherein the elongated member pivotally engages the probe bar so that the elongated member can be positioned either substantially parallel to the bar driver when the bar is being driven into the ground, or substantially perpendicular to the bar when the bar is being removed from the ground.

20. A method for removing probe bars from a ground surface comprising:

a) engaging an exposed portion of a probe bar with a probe bar remover; the probe bar remover including an elongated member having an engagement end opposite a handling end and a foot plate oriented at the handling end, wherein the foot plate is a plate positioned above a top surface of the elongated member or is an integrated plate along a section of the elongated member; a bar engagement member attached to the elongated member at the engagement end configured to rotationally bind and releaseably engage the probe bar; a fulcrum intermediate the elongated member to contact a ground surface; and a handlebar attached at the handling end; and b) exerting a downward force on the foot plate such that the bar engagement member is forced upward sufficient to at least loosen the probe bar from the ground.

21. A method for removing probe bars from a ground surface according to claim 20, further comprising releasing the bar engagement member by moving the foot plate upward and repeating the step of exerting a downward force until the probe bar is loosened from the ground.

22. A method for removing probe bars from a ground surface according to claim 20, wherein exerting the downward force on the foot plate comprises exerting substantially all of the force sufficient to at least loosen the probe bar at the footplate.

* * * * *

UNITED STATES PATENT AND TRADEMARK OFFICE

CERTIFICATE OF CORRECTION

PATENT NO. : 8,413,959 B2
APPLICATION NO. : 12/295415
DATED : April 9, 2013
INVENTOR(S) : Donald S. Bloswick et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 311 days.

Signed and Sealed this
Twenty-eighth Day of July, 2015

Michelle K. Lee

Michelle K. Lee
*Director of the United States Patent and Trademark Office*